US008770167B2

(12) United States Patent
Wenckel

(10) Patent No.: US 8,770,167 B2
(45) Date of Patent: Jul. 8, 2014

(54) STARTING DEVICE FOR COMBUSTION ENGINE

(75) Inventor: Mathias Wenckel, Hamburg (DE)

(73) Assignee: Makita Corporation, Anjo-Shi (JP)

( * ) Notice: Subject to any disclaimer, the term of this patent is extended or adjusted under 35 U.S.C. 154(b) by 896 days.

(21) Appl. No.: 12/862,453

(22) Filed: Aug. 24, 2010

(65) Prior Publication Data

US 2011/0048359 A1 Mar. 3, 2011

(30) Foreign Application Priority Data

Aug. 25, 2009 (DE) ..... 20 2009 011 429 U
Aug. 25, 2009 (DE) ..... 20 2009 011 430 U

(51) Int. Cl.
*F02N 1/00* (2006.01)

(52) U.S. Cl.
USPC ..... 123/185.3

(58) Field of Classification Search
USPC ..... 123/185.14, 185.2, 185.3, 185.4; 185/39, 41 A, 41 C, 41 R; 267/154, 267/166.1, 275; 16/75
See application file for complete search history.

(56) References Cited

U.S. PATENT DOCUMENTS

| | | | | |
|---|---|---|---|---|
| 3,779,537 | A * | 12/1973 | Kalister | 267/166.1 |
| 4,284,161 | A * | 8/1981 | Blass | 180/184 |
| 4,480,605 | A * | 11/1984 | Bloemers | 123/185.3 |
| 6,239,393 | B1 * | 5/2001 | Hansen | 200/276 |
| 6,971,359 | B2 * | 12/2005 | Tohyama | 123/185.3 |
| 6,986,508 | B2 * | 1/2006 | Alers et al. | 267/179 |
| 7,140,341 | B2 * | 11/2006 | Dahlberg | 123/185.3 |
| 8,215,279 | B2 * | 7/2012 | Ziegs | 123/185.3 |

FOREIGN PATENT DOCUMENTS

| | | | |
|---|---|---|---|
| CN | 1757904 | A | 4/2006 |
| CN | 1892018 | A | 1/2007 |
| CN | 101245754 | A | 8/2008 |
| DE | 203 01 182 | U1 | 7/2004 |
| DE | 203 19 902 | U1 | 7/2004 |
| DE | 603 04 245 | T2 | 12/2006 |
| WO | WO 02/103879 | A1 | 12/2002 |

OTHER PUBLICATIONS

German Search Report issued in Application No. 20 2009 011 430.9; dated Jul. 15, 2010 (with translation).

* cited by examiner

*Primary Examiner* — Erick Solis
*Assistant Examiner* — Carl Staubach
(74) *Attorney, Agent, or Firm* — Oliff PLC

(57) ABSTRACT

In order to create a starting device for at least one combustion engine, more preferably cable-operated starting device for at least one two-stroke or four-stroke engine with at least one cable disc or cable drum rotatably mounted in a housing, which for generating a drive rotational moment for an engine shaft which by means of at least one starting handle or pulling handle via at least one force transmission means more preferably via a starting cable or pulling cable can be rotated and via at least one elastic coupling link is connected with at least one driving link more preferably with at least one pawl driver by means of which the drive rotational moment can be transmitted to the engine shaft, the coupling link has two ends, wherein an end is engaged with the driver link and another end with the cable disc or the cable drum, it is proposed through direct operational connection of force transmission means and elastic link/coupling link to configure preferably easily that another end of the coupling link is engaged with the cable disc or the cable drum and the force transmission means.

10 Claims, 5 Drawing Sheets

STARTING DEVICE FOR COMBUSTION ENGINE

FIELD OF THE INVENTION

The invention relates to a starting device for at least one combustion engine, more preferably cable-operated starting device for at least one two-stroke or four-stroke engine with at least one cable disc or cable drum rotatably mounted in a housing which for generating a drive rotational moment for an engine shaft can be rotated by means of at least one starter handle or pulling handle via at least one force transmission means, more preferably a starter cable or pulling cable and via at least one elastic coupling link is connected with at least one driver link, more preferably with at least one pawl driver, by means of which the drive rotational moment can be transmitted to the engine shaft, the coupling link having two ends wherein an end is engaged with the driver link and another end with the cable disc or the cable drum.

BACKGROUND

Such a starting device is known for example from DE 203 01 182 U1 and DE 203 19 902 U1. With the starting devices described there it is always necessary that good cooling of the combustion engine with a cooling air flow leading through the starting device to a fan can take place.

The starting device, as described in the two above-mentioned documents is accommodated in a housing in front of the combustion engine. The combustion engine is cooled by means of the air passing through the starting device. The ventilation elements of the housing, such as for example ventilation slots allow the entry of a cooling air flow into a fan arranged behind the starter for cooling the combustion engine. However, the cooling air flow with such devices is frequently shielded from the housing to the combustion engine by elements of the starting device, or the cooling air flow is disturbed by the elements of the starting device.

Since starting devices of this type are frequently used in devices such as for example power chain saws which are exposed to high loads, preferably good cooling of the combustion engine is desirable.

Furthermore, a cable-operated starting device for a combustion engine is known from EP 1 396 060 A2. It also describes the same arrangement of the starting device as already described above for the prior art.

SUMMARY

The invention is based on the object of achieving improved cooling of the combustion engine with a starting device of the type mentioned at the outset.

This object is solved through the feature combination stated in Claim 1.

According to the teaching of the present invention the coupling element is now embodied as a spring wound from wire with reducing cross-sectional areas whose tapering shape follows the inflowing cooling air flow of the ventilation elements of the housing.

Cross-sectional area in this case does not mean the cross-sectional area of the spring wire but the area enclosed by a spring coil.

With a configuration according to the invention clearly improved cooling of the combustion engine arranged downstream of the starter is achieved since the cooling air inflow into the fan arranged behind the starter is improved and thus a favourable flow onto a fan carrying blades is achieved.

In addition to this, the configuration according to the invention of the starter device combines the advantage of not acting in a manner impeding cooling air inflow with the advantage of being adequately dimensioned for the specific application in terms of spring force.

An additional advantage of using a spring wound from wire whose cross-sectional areas substantially diminish from one end to the other that the space required in the starter is also less.

A wound spring having a uniform cross section of the smallest cross section of the spring would not have adequate spring force and would therefore not be useable with a starting device according to the invention.

A spring having a uniform cross section of the largest cross section of the spring would be sufficient in terms of spring force in a starting system according to the invention but would impede the inflowing cooling air flow and thus result in poorer cooling of the combustion engine.

Advantageous configurations of the invention are characterized in the subclaims.

According to the present invention it is not necessary that the spring is configured in circular shape and thus as a truncated cone. On the contrary, all possible wound shapes with tapering cut areas such as for example truncated pyramids, truncated tetrahedrons etc. are conceivable. Likewise a truncated cone shape with elliptic cross-sectional areas or a truncated pyramid shape with polygonal cross-sectional areas would be conceivable.

According to a preferred embodiment the wound spring is a tapering coil spring. Such coil springs are commercially available easily and cost-effectively.

According to a preferred embodiment the spring is also configured so that the spring has a progressive spring characteristic. Thus it is possible for example when loading the spring to first utilise the larger coils and let them "go on block" in order to subsequently utilise the smaller coils utilising the progression. Such a progressive spring characteristic harmonises very favourably with the force curve in the starting device. The rotational moment to be generated on the engine shaft during the starting operation is subject to intense fluctuations for a very high rotational moment needs to be generated in the compression phase of the piston up to top dead centre while the rotational moment to be generated drops during the expansion phase.

Particularly good progression characteristics of the spring can be achieved if the ratio of diameter or length meter on a base area and a top area of the spring amounts to 0.9 or less, preferentially 0.8 to 0.6 and particularly preferably approximately 0.73.

Preferentially the wire diameter of the spring is in the range from 2 to 4 mm and according to a further preferred embodiment amounts to 2.5 to 3.5 mm. According to a particularly preferred embodiment it is provided that the wire diameter amounts to approximately 2.8 mm.

The wire of the spring could have any other conceivable cross-sectional shapes such as for example a round, an oval, a square and/or a triangular cross section.

Commercially available spring steel can be used as material for the spring. However it would also be conceivable that a copper-tin alloy is used. The material could additionally comprise a coating.

BRIEF DESCRIPTION OF THE DRAWINGS

An exemplary embodiment of the invention is explained in more detail in the following by means of the drawing. Here it shows.

In the representation of the prior art and the shown embodiment the corresponding elements are named with the same reference characters while the reference characters of the prior art are furnished with an apostrophe.

DETAILED DESCRIPTION OF THE EMBODIMENTS

Figure 1:
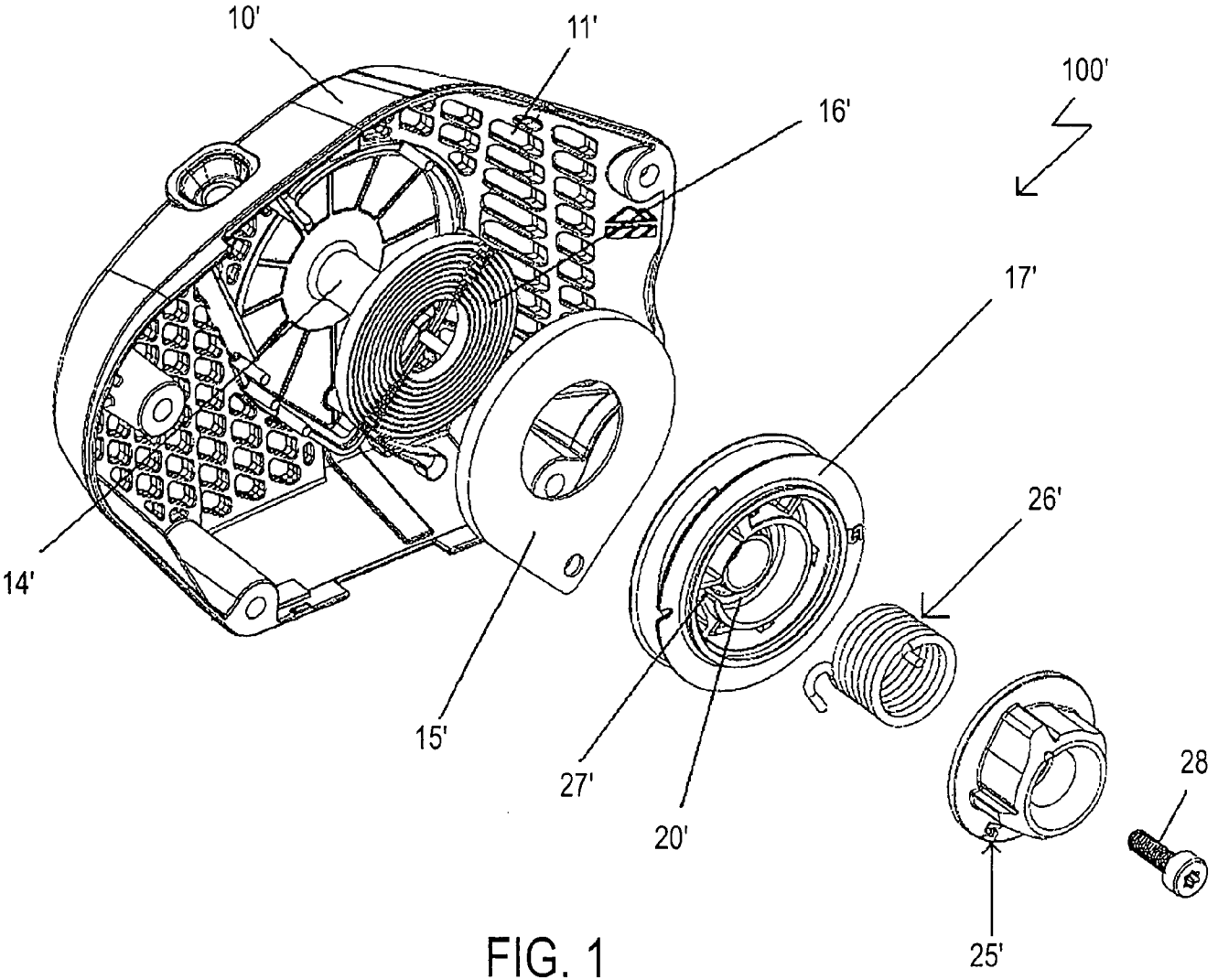
FIG. 1 a schematic exploded view of a starting device according to the prior art.
Figure 2:
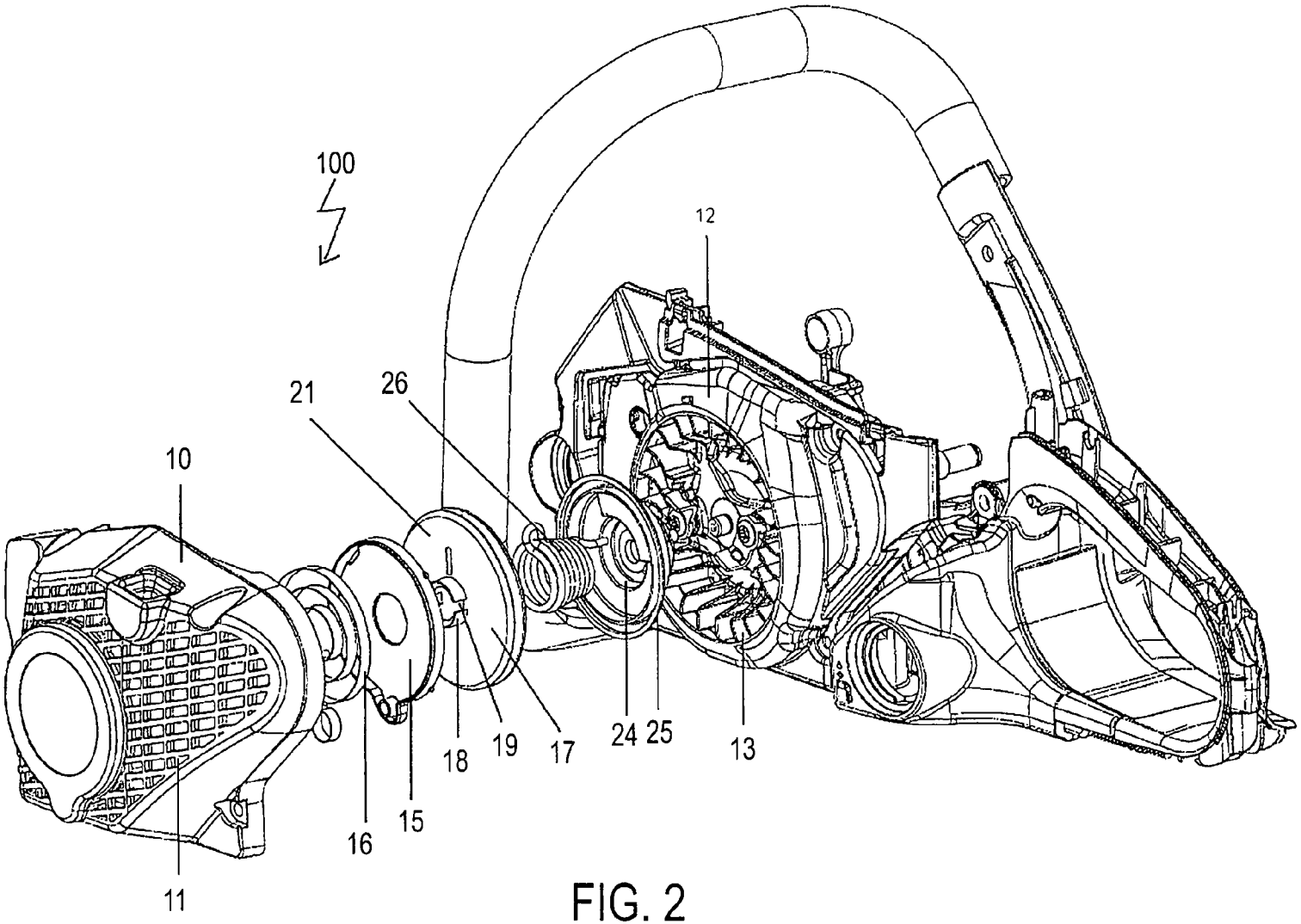
FIG. 2 a schematic exploded view of a starting device according to a preferred embodiment and the combustion engine as well as parts of the device in which these are inserted.
Figure 3:
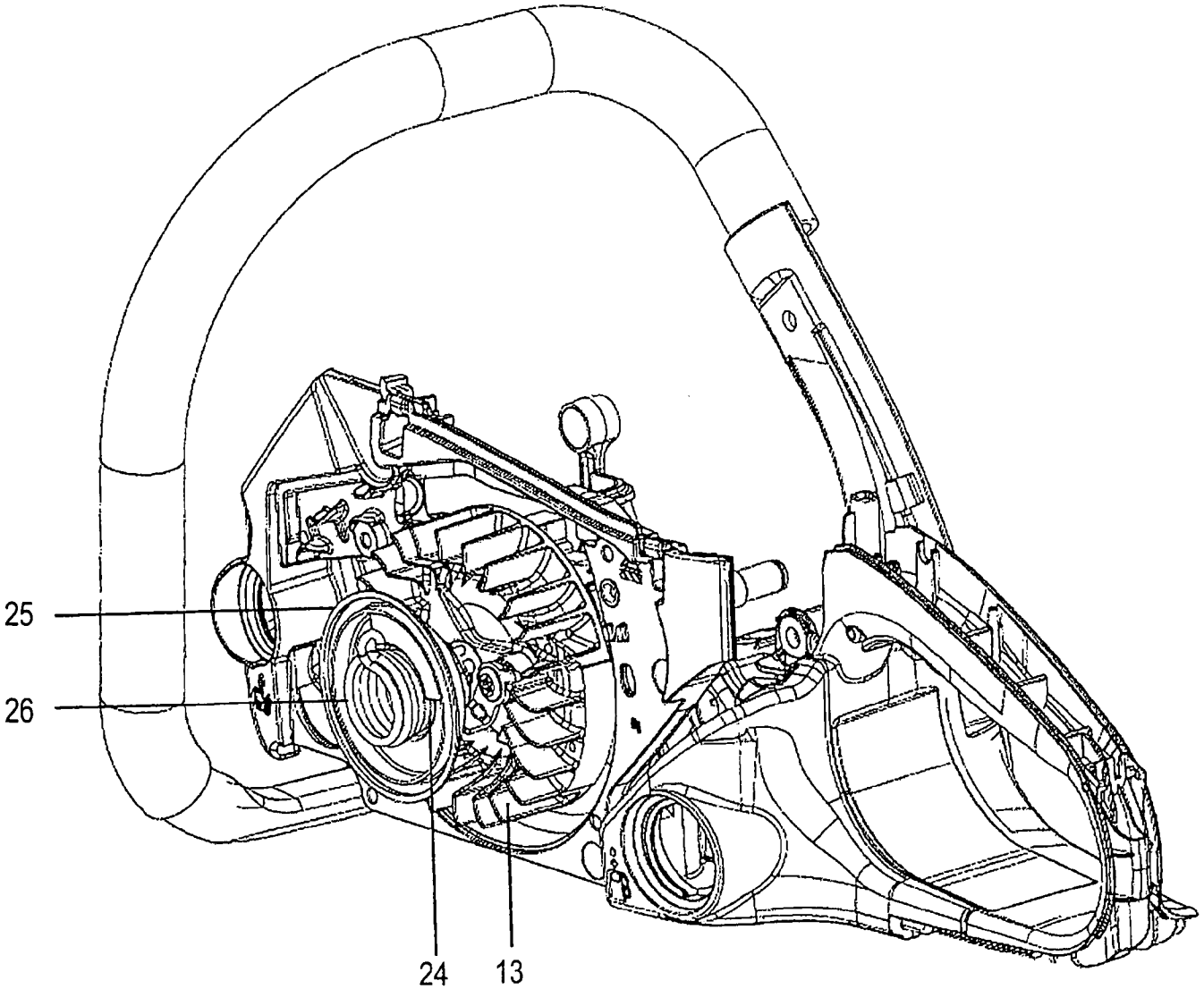
FIG. 3 a schematic view of a device according to the embodiment shown in FIG. 2 with elements in the installed state.

FIG. 1 shows a starting device 100' as is known from the prior art. Such a starting device 100', as well as the starting device 100 shown in FIGS. 2 and 3 is intended for the manual starting of a combustion engine which for example belongs to a power chain saw. The cable-operated starting device 100, 100' is accommodated in a housing 10, 10' which both in the case of the version according to the prior art (FIG. 1) as well as in the case of the shown exemplary embodiment of the invention (FIGS. 2 and 3) is a removable lid of the engine housing provided with ventilation slots 11, 11' in which among other things an air guide 12 is integrated and a magnet wheel 13 adjoining the latter. From the interior wall of the housing 10, 10' a bearing pin 14' emerges (only visible in FIG. 1) which is surrounded by a substantially likewise housing-fixed spring housing 15, 15' for a coil-shaped starter spring 16, 16' clamped in on one side at the edge of the spring housing 15, 15'. This starter spring 16, 16' serves as retraction spring for the cable disc or cable drum 17, 17'.

The cable disc or cable drum 17, 17' comprises a pin 18 at the back (see FIG. 2) which, through a centre bore of the spring housing 15, 15', protrudes into the latter and has an axial slot for the engagement of the inner end of the coil-shaped starter spring 16, 16'. On the cable disc or cable drum 17, 17' a starter cable or pulling cable (not shown) is wound as force transmission means whose free end leads out of the housing 10, 10' and is fastened to a handle. By pulling the starter cable by means of the handle the cable disc or cable drum 17, 17' is put in motion about the bearing pin 14' subject to the unwinding of the starter cable or pulling cable.

The cable disc or cable drum 17, 17' comprises a circular mounting space 20' surrounding the bearing pin 14' which towards the starter springs 16/16' is limited by the face wall 21. Between this face wall 21 of the cable disc or cable drum 17' 17' and a mounting space 24 of a pawl driver link 25, 25' a coil spring 26, 26' is arranged.

The outer end, that is the end of the coil spring 26, 26' facing the face wall 21 of the cable disc or cable drum 17, 17' is hooked into a slot 27' which is provided in a ring-shaped shoulder of the face wall 21. This shoulder encloses the coil spring 26, 26' whose outer coil bears against the inner wall of the shoulder. The end of the coil spring 26, 26' facing the pawl driver link 25, 25' is mounted in the pawl driver link 25, 25'.

In the mounted state of the starting device 100 the housing-fixed bearing pin 14 penetrates a centre bore of the face wall of the cable disc or cable drum 17, 17' so that this centre bore forms a bush-shaped mounting for the bearing pin 14'. In an axial internal thread of the bearing pin 14' a fastening screw 28' whose head is fastened to the pawl driver link 25, 25'.

When the cable disc or cable drum 17, 17' is put in rotary motion through pulling on the starter cable or pulling cable the cable disc or cable drum 17, 17' drives the pawl driver link 25, 25' via the coil spring 26, 26'. Thus, the rotary movement of the cable disc or cable drum 17, 17' and thus the rotational moment can be transmitted to the engine shaft to be driven by means of this pawl driver link 25, 25'.

The coil spring 26', as is shown in FIG. 1 according to the prior art, constitutes a cylindrical coil spring and the pawl driver link 25' is thus embodied accordingly.

In contrast with the embodiment according to the prior art shown in FIG. 1 the coil spring 26 in FIGS. 2 and 3 is embodied as a truncated cone according to a preferred embodiment of the present invention whose base area faces the cable disc or cable drum 17 while the top area faces the pawl driver link 25.

A coil spring 26 configured in this manner leads to clearly improved ventilation behaviour of the combustion engine since the inflow of the cooling air through the starting device 100 in the air guide 12 arranged after the starting device is improved, since the conical spring 26 follows the inflowing cooling air flow and thus positively guides the cooling air flow.

In addition to this, the compression in the combustion engine always increases when driving or rotating the engine shaft up to its dead centre position of the piston after which it drops again; accordingly, the reaction moment fluctuates periodically which with a conventional starting device results in high force peaks that have to be generated during starting. For offsetting this, the coupling element and here, according to the shown embodiment, a coil spring 26, 26' are provided.

According to the embodiment of the prior art the coil spring 26' is so dimensioned that the pawl driver link 25' is driven with the rotational speed of the cable disc or cable drum 17' for as long as the reaction moment of the engine shaft remains below a predetermined limit value, wherein the piston of the combustion engine is in the region before and after its dead centre position. When the reaction moment rises above this limit value the coil spring 26' deforms by contracting its coils so that the rotational speed of the pawl driver link 25' decreases, while the cable disc or cable drum 17' can be rotated further with the same rotational speed and with only moderately rising force expenditure.

According to the embodiment shown in FIGS. 2 and 3 a coil spring 26 is now employed wherein the diameter ratio of top area to base area is approximately 0.73. Furthermore, a wire for the coil spring with a diameter of approximately 2.8 mm was used.

With such a configuration of the invention the spring develops a progressive spring characteristic. Thus the coil spring 26 is not directly deformed when exceeding a limit value as described above, but it is possible at first to have the larger coils go on block in order to subsequently utilise the smaller coils of the coil spring 26 by utilising a progression, so that here, too, the rotational speed of the pawl driver link 25 decreases, while the cable disc or cable drum 17 can be rotated further with the same rotational speed and with only moderately rising force expenditure.

Figure 4A:
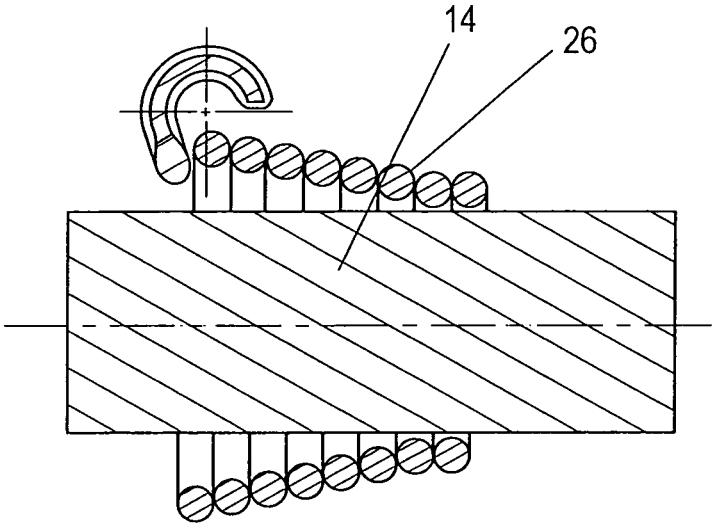
FIG. 4 a schematic sectional view of three possibilities of the coil spring wound about a bearing pin.

FIG. 4 shows a detail of a device according to the invention, specifically a bearing pin 14 on which a coil spring 26 is located. FIGS. 4*a*) 4*b*) and 4*c*) show different configurations of the shape of the bearing pin which leads to different spring characteristics. The embodiment shown in FIG. 4*a*) shows a conical coil spring 26 which is arranged about a cylindrical bearing pin. Such a configuration results in a linear spring characteristic.

Figure 4B:
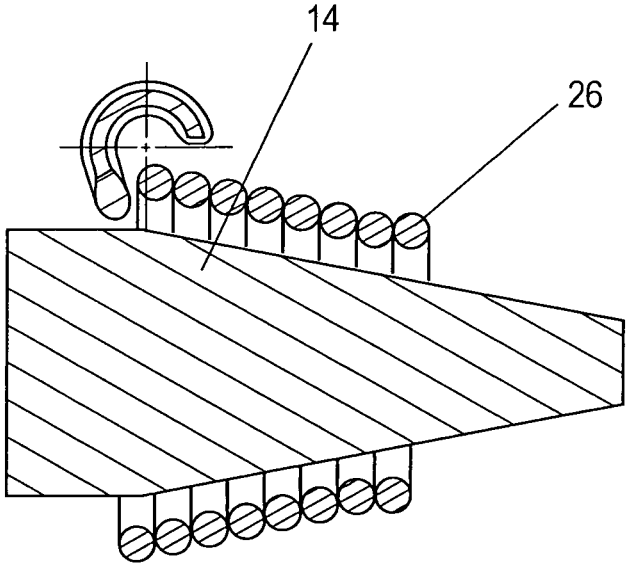

The embodiment shown in FIG. 4*b*) shows a conical coil spring 26 which is arranged about a bearing pin 14 which has a cone angle corresponding to the coil spring 26. Such configuration results in a degressive spring characteristic.

Figure 4C:
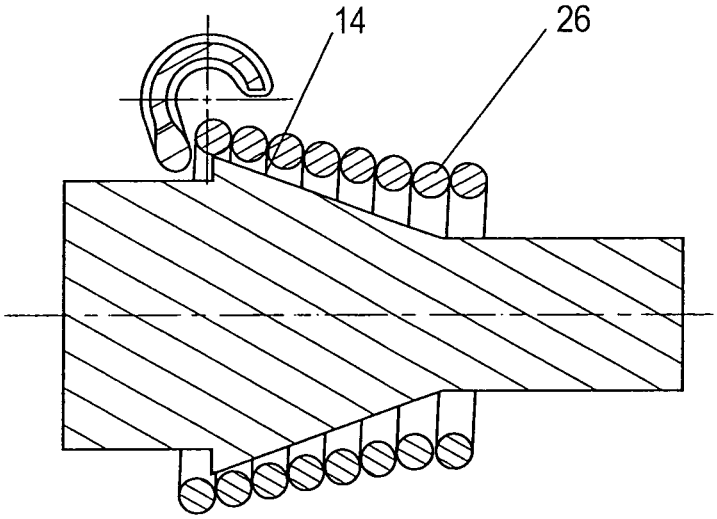

FIG. 4*c*) shows a conical coil spring 26 which is arranged about a conical bearing pin 14 whose cone falls off more severely than the cone of the coil spring 26 and thus results in a progressive spring characteristic.

LIST OF REFERENCE

100/100' Starting device
10/10' Housing
11/11' Ventilation slots
12 Air guide
13 Magnet wheel
14/14' Bearing pin
15/15' Spring housing
16/16' Starter spring
17/17' Cable disc or cable drum
18 Pin of cable disc or cable drum
19 Axial slot
20' Mounting space of cable disc or cable drum
21/21' Face wall of cable disc or cable drum
24 Mounting space of a pawl driver link
25/25' Pawl driver link
26/26' Coil spring
27' Slot in the face wall 21/21'
28' Fastening screw

The invention claimed is:

1. A starting device for at least one combustion engine, comprising:

at least one cable disc or cable drum rotatably mounted in a housing which for generating a drive rotational moment for an engine shaft can be rotated by means of at least one starting handle or pulling handle via at least one force transmission means by means of which the drive rotational moment can be transmitted, and a coupling link that transfers the drive rotational moment from the at least one force transmission means to the engine shaft via a driver link, wherein:

the coupling link has two ends, an end is engaged with the driver link and another end with the cable disc or the cable drum, and the coupling link comprises a three-dimensional spring wound from wire whose cross-sectional areas continuously diminish from the end facing the cable disc or the cable drum towards the end facing the driver link.

2. The starting device according to claim 1, wherein the wound spring has a truncated cone shape with round or elliptic cross-sectional areas or a truncated pyramid shape with square or polygonal cross-sectional areas.

3. The starting device according to claim 1, wherein the wound spring is a tapering coil spring.

4. The starting device according to claim 1, wherein the spring has a progressive characteristic curve.

5. The starting device according to claim 1, wherein a ratio of diameter or length meter on a base area and a covering area of the wound spring amounts to 0.9 or less.

6. The starting device according to claim 1, wherein a ratio of the diameter or length meter on a base area and a covering area of the wound spring is in the range from 0.8 to 0.6.

7. The starting device according to claim 1, wherein a wire diameter of the spring is in the range from 2 to 4 mm.

8. The starting device according to claim 1, wherein the wire diameter is approximately 2.8 mm.

9. The starting device according to claim 1, wherein the wire of the spring has a round or an oval or a square or a triangular cross section.

10. The starting device according to claim 1, wherein a length of the spring from the end facing the cable disc or cable drum to the end facing the driver link is in the region of smaller than 10 mm.

* * * * *